US005338217A

United States Patent [19]

Saitoh et al.

[11] Patent Number: 5,338,217

[45] Date of Patent: Aug. 16, 1994

[54] CONNECTOR TERMINAL

[75] Inventors: Hitoshi Saitoh; Takayoshi Endo; Sakai Yagi; Kimihiro Abe; Seiji Koumatsu, all of Shizuoka, Japan

[73] Assignee: Yazaki Corporation, Japan

[21] Appl. No.: 7,743

[22] Filed: Jan. 22, 1993

[30] Foreign Application Priority Data

Jan. 22, 1992 [JP] Japan ..... 4-001737[U]

[51] Int. Cl.[5] ..... H01R 11/28

[52] U.S. Cl. ..... 439/246; 439/852

[58] Field of Search ..... 439/246, 252, 682, 851-855, 439/381, 856, 857, 842-850

[56] References Cited

U.S. PATENT DOCUMENTS

| | | | |
|---|---|---|---|
| 2,188,530 | 1/1940 | Del Camp | 439/851 |
| 2,948,877 | 8/1960 | Batcheller . | |
| 3,550,067 | 12/1970 | Hansen | 439/682 |
| 3,711,819 | 1/1973 | Matthews | 439/682 |
| 4,859,198 | 8/1989 | Owen | 439/857 |

FOREIGN PATENT DOCUMENTS

| | | | |
|---|---|---|---|
| 2032194 | 1/1972 | Fed. Rep. of Germany | 439/851 |
| 1238389 | 1/1989 | Japan . | |
| 8807774 | 10/1988 | PCT Int'l Appl. | 439/851 |
| 8905531 | 6/1989 | PCT Int'l Appl. | 439/851 |

*Primary Examiner*—Gary F. Paumen

*Attorney, Agent, or Firm*—Venable, Baetjer, Howard & Civiletti

[57] ABSTRACT

An improved connector terminal is provided that is capable of being inserted more easily into a terminal accommodating chamber of a connector housing.

The connector terminal comprises a wire connecting part and an electric contact part that may be inserted into the terminal accommodating chamber of a connector housing having an opening edge. The electric contact part includes a rectangular cylindrical body having two pairs of opposing walls for a total of four walls and a guide protrusion protruding continually from the tip of at least one of the four walls of the body. The guide protrusion has a guide surface that slides along the opening edge of the connector housing when the electric contact part is inserted into the terminal accommodating chamber. The guide protrusion is structured to protrude from one of the four walls so as to have substantially the same width as the wall width or structured so that a bent guide surface is formed by extending and bending tips of at least two of the four walls that have a width smaller than the width of the respective wall.

11 Claims, 5 Drawing Sheets

CONNECTOR TERMINAL

BACKGROUND OF THE INVENTION

1. Field of the Invention

The present invention relates generally to a connector terminal employed for connecting electric wires and, more particularly, to a connector terminal having a wire connecting part on one side and a rectangular cylindrical electric contact part on the other side that may be inserted into a terminal accommodating chamber of a connector.

2. Related Background Art

This type of conventional connector terminal is disclosed in Japanese Utility Model Laid-Open Publication No. 64-12383. The connector terminal disclosed therein has a wire connecting part on one side and a rectangular cylindrical electric contact part on the other side. The electric contact part incorporates a tongue-shaped spring member. The connector terminal may be inserted into a terminal accommodating chamber of a connector housing in a state where wires are connected. The terminal accommodating chamber has a tapered opening edge for receiving the terminal, thereby improving the insertability of the terminal.

The conventional connector terminal, however, presents the following problems. An outer periphery of the edge of the rectangular cylindrical electric contact part assumes an angular line. Therefore, if the connector itself is made compact by reducing a clearance between the terminal accommodating chamber and the terminal, the insertability declines. The tip of the terminal may be caught on the opening edge, and hence the terminal can not be smoothly inserted.

An aim of the present invention is to obviate the defects described above.

SUMMARY OF THE INVENTION

Accordingly, it is a primary object of the present invention to provide an improved connector terminal capable of being inserted into a terminal accommodating chamber of a connector housing with enhanced working efficiency.

It is another object of the present invention to provide a connector terminal capable of being smoothly inserted into even a narrow terminal accommodating chamber and allowing the connector to be compact.

To accomplish the objects described above, a connector terminal according to the present invention is formed with a wire connecting part on one side and an electric contact part on the other side that may be inserted into a terminal accommodating chamber of a connector. The electric contact part includes a rectangular cylindrical body having two pairs of opposing walls for a total of four walls. The electric contact part further includes a guide protrusion protruding continually from the tip of at least one of the four walls of the body. The guide protrusion has a guide surface that slides along an opening edge of the connector housing when the electric contact part is inserted into the terminal accommodating chamber.

In accordance with a first embodiment of the present invention, the guide surface is formed as an oblique surface. The oblique guide surface slides on the opening edge of the terminal accommodating chamber. The terminal is thus smoothly led into the opening.

In accordance with another embodiment of the present invention, guide protrusions are formed by extending edges of at least two of the four walls of the electric contact part, that have a width smaller than the width of each wall and bending the edges to form bent guide surfaces. A square notched part is formed in combination with bent guide surfaces. The bent guide surfaces slide on the opening edge of the terminal accommodating chamber. The square notched part serves to prevent the terminal from being caught on the opening edge. The terminal is thereby smoothly led into the opening.

The embodiments of the present invention will hereinafter be described with reference to the accompanying drawings.

BRIEF DESCRIPTION OF THE DRAWINGS

Other objects and advantages of the present invention will become apparent during the following discussion with reference to the drawings, in which.

DESCRIPTION OF THE PREFERRED EMBODIMENTS

Figure 1:
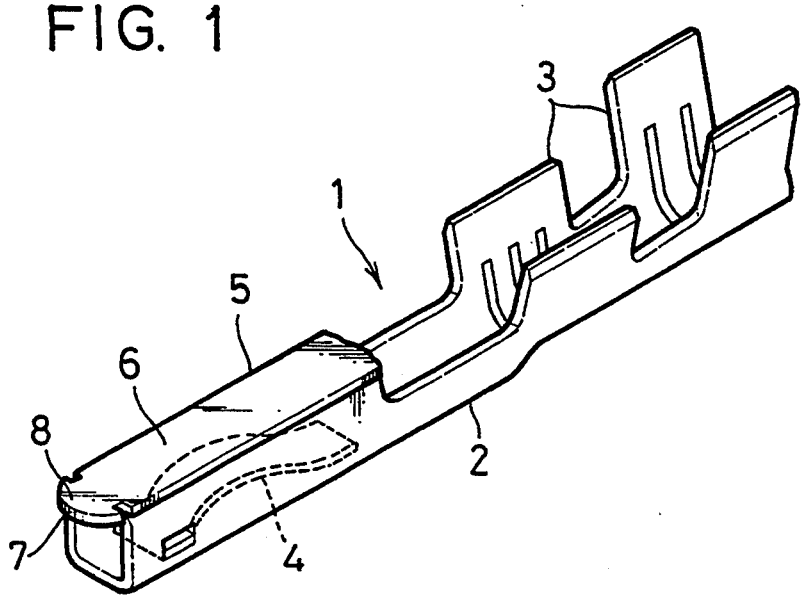
FIG. 1 is a perspective view illustrating a first embodiment of a connector terminal according to the present invention.

Referring to FIG. 1, a connector terminal 1 of a first embodiment of the present invention includes a conductive metal base 2. The base 2 is integrally formed with a wire connecting part 3 on one side and a rectangular electrical contact part 5 having two pairs of opposing walls for a total of four walls on the other side. The electric contact part 5 incorporates a tongue-shaped spring member 4. The spring member 4 is formed as separate member mounted to the electric contact part 5. A guide protrusion 8 having a curved oblique guide surface 7 protrudes continually from the tip of an upper wall 6 of the electric contact part 5. The guide protrusion 8 is formed so as to have substantially the same width as that of the upper wall 6.

Figure 2:
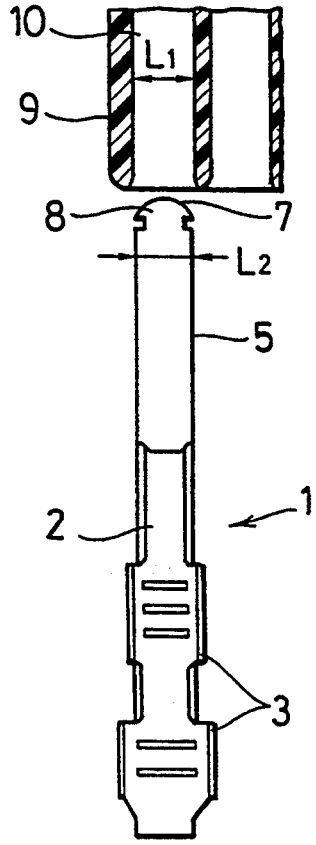
FIG. 2 is a plan view as viewed from above, showing a state where the connector terminal in FIG. 1 is being inserted into a terminal accommodating chamber of a connector housing illustrated in cross-section.
Figure 3:
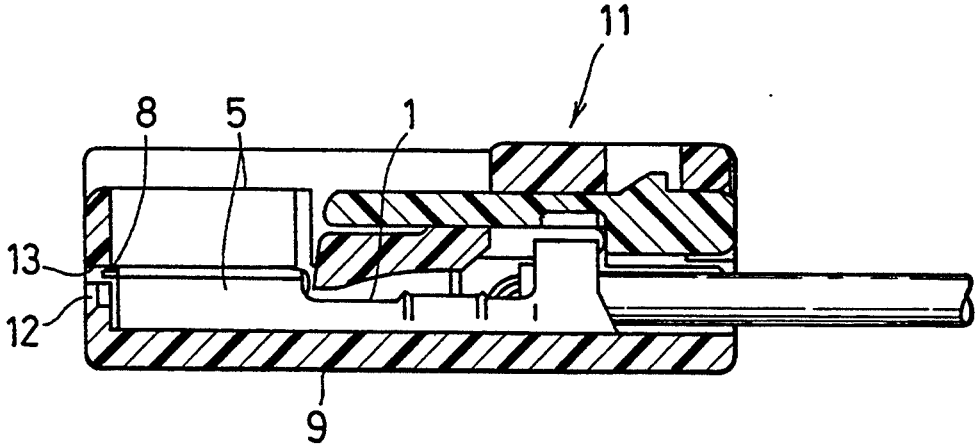
FIG. 3 is a vertical sectional view showing a state where the connector terminal is inserted into the terminal accommodating chamber of the connector housing.

Referring to FIGS. 2 and 3, the connector terminal 1 is inserted into a terminal accommodating chamber 10 of a connector housing 9 for a connector 11. As illustrated in FIG. 2, even when a width $L_1$ of the terminal accommodating chamber 10 is set approximate to a width $L_2$ of the electric contact part 5, the connector terminal 1 is smoothly insertable into the terminal accommodating chamber 10 with guidance by the curved oblique guide surface 7 of the guide protrusion 8. Hence, the connector 11 itself can be made compact. As shown in FIG. 3, the guide protrusion 8 of the connector terminal 1 is shifted and accommodated in a notched groove 13 adjacent to a partner terminal insertion port 12 of the connector housing 9.

Figure 4:
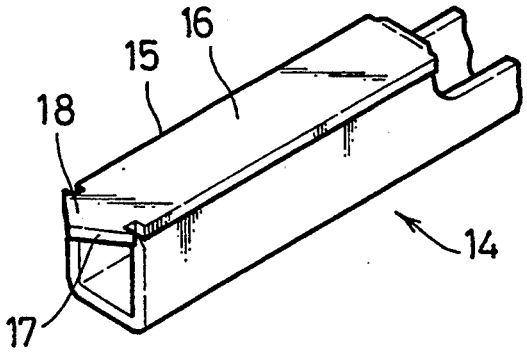
FIG. 4 is a principal perspective view showing a first modified example of the connector terminal in FIG. 1.
Figure 5:
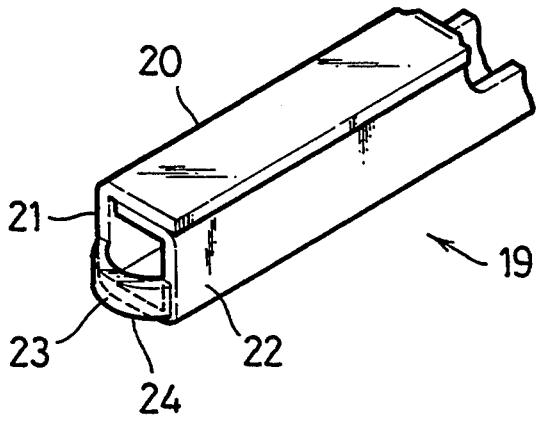
FIG. 5 is a principal perspective view showing a second modified example of the connector terminal in FIG. 1.
Figure 6:
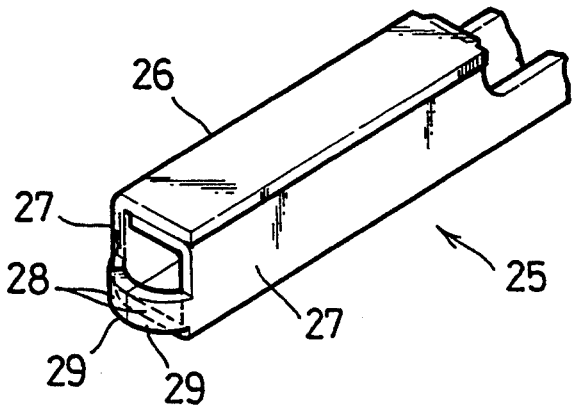
FIG. 6 is a principal perspective view showing a third modified example of the connector terminal in FIG. 1.

FIGS. 4–6 show modified examples of the connector terminal described above.

A connector terminal 14 in FIG. 4 is constructed such that a guide protrusion 18 having in an arrowhead-like configuration with an oblique guide surface 17 extends continually from the tip of an upper wall 16 of a rectangular cylindrical electric contact part 15. A connector terminal 19 in FIG. 5 is constructed such that a guide protrusion 24 having a bent oblique guide surface 23 extends continually from the tip of one side wall of a rectangular cylindrical electric contact part 20 toward the tip of the other side wall 22. A connector terminal 25 in FIG. 6 is constructed such that guide protrusions 29, 29 each having a curved oblique guide surface 28 protrude from the tips of two side walls 27, 27 of an electric contact part 26; and the guide protrusions are joined at the center.

Figure 7:
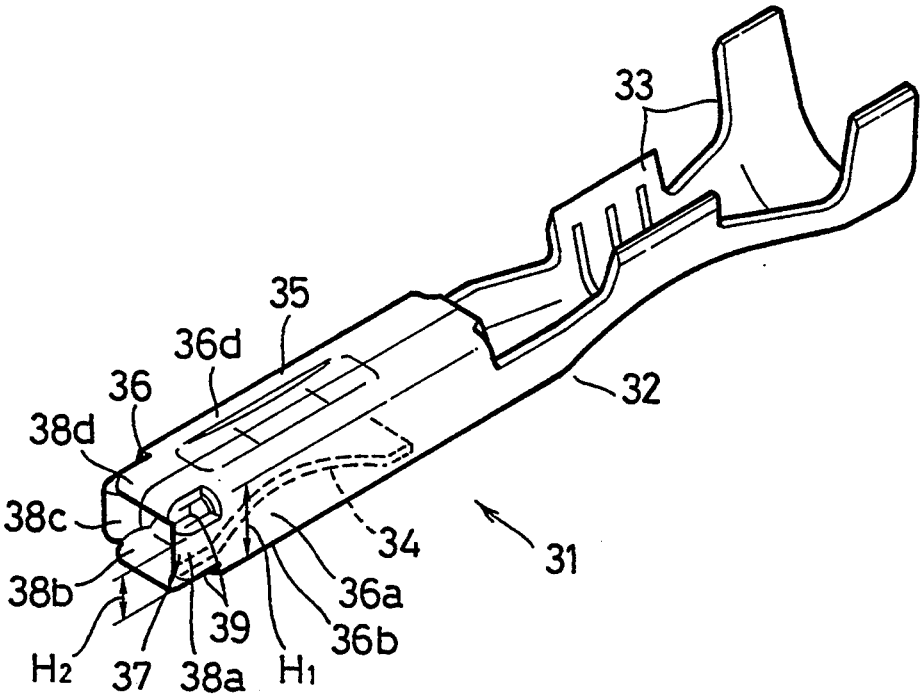
FIG. 7 is a perspective view showing a second embodiment of a connector terminal according to the present invention.

Next, a second embodiment of the connector terminal according to the present invention will be described with reference to FIG. 7.

A connector terminal 31 includes a base 32. The base 32 is integrally formed with a wire connecting part 33 on one side and a rectangular cylindrical electric contact part 35 having four walls **36*a*–36*d* on the other side. The electric contact part 35 incorporates a tongue-shaped spring member 34. Respective tips of the four walls 36*a*–36*d* of the electric contact part 35 are formed with extension members. The extension members, each having a width $H_2$ smaller than a width $H_1$ of the respective wall 36*a*–36*d*, are bent inward. Guide protrusions 38*a*–38*d* having bent guide surfaces 37 are thereby formed continually from the tip of the electric contact part 35. At the same time, a square notched part 39** is formed.

Figure 8:
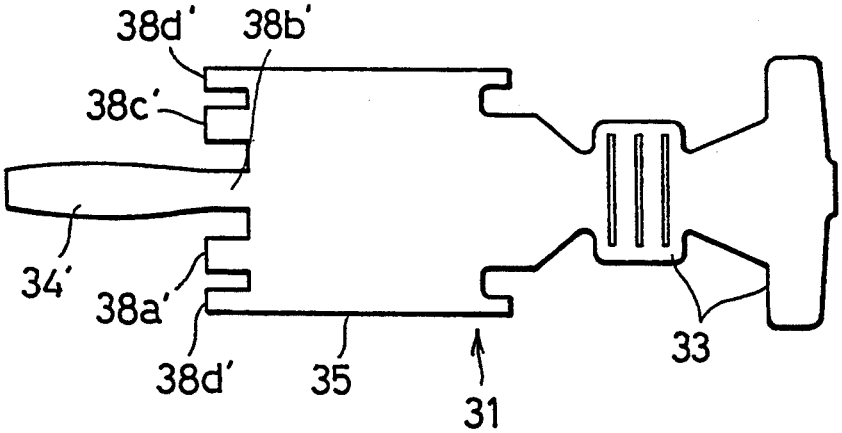
FIG. 8 is a development of the connector terminal in FIG. 7.

In the connector terminal 31, as illustrated in FIG. 8, the wire connecting part 33 and the electric part 35 are continuously formed in symmetry about a longitudinal axis by punching out a sheet of conductive metal plate. A tongue-shaped spring member 34' extends at the center of the tip of the electric contact part 35. Protruded on both sides of the tongue-shaped spring member 34' are extension members **38*a*', 38*c*' corresponding to the two side walls 36*a*, 36*c* of the four walls and half-split extension members 38*d*', 38*d*' corresponding to the upper wall 36*d***.

Figure 9:
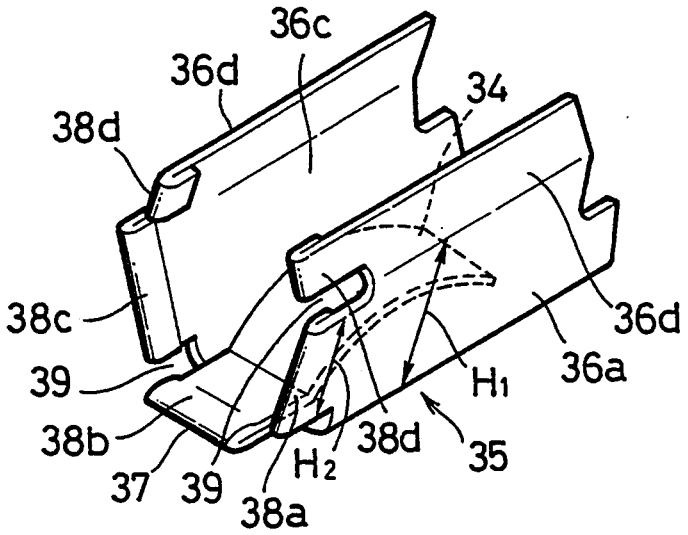
FIG. 9 is a principal perspective view showing processes of forming the connector terminal in FIG. 7.
Figure 10:
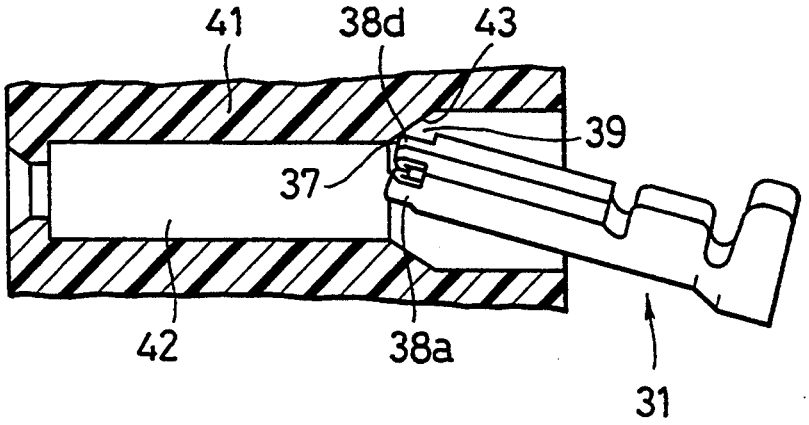
FIG. 10 is a vertical sectional view showing a state where the connector terminal shown in FIG. 7 is inserted into the terminal accommodating chamber.

As shown in FIG. 9, the tongue-shaped spring member 34' is bent inward, whereby the tongue-shaped spring member 34 extends continually from the guide protrusion **38*b*. The extension members 38*a*', 38*c*', 38*d*' are similarly bent, thus forming the guide protrusions 38*a*, 38*c*, 38*d* having bent guide surfaces 37. The two side walls 36*a*, 36*c* and the half-split upper walls 36*d*, 36*d* are bent in face-to-face directions, thus forming the rectangular cylindrical electric contact part 35. The width $H_2$ of each of the guide protrusions 38*a*–38*d* is set smaller than the width $H_1$ of each of the walls 36*a*–36*d*. The square notched part 39 is thus formed between the guide protrusions 38*a*–38*d*. As illustrated in FIG. 10, when inserting the connector terminal 31 into the terminal accommodating chamber 42 of the connector housing 41, the bent guide surfaces 37 of the guide protrusions 38*a*–38*d* of the tip thereof slide along an opening edge 43 of the terminal accommodating chamber 42. Further, the square notched part 39 prevents the terminal 31 from being caught on the opening edge 43. The terminal 31** is thereby smoothly led into the opening.

According to the present invention, the tip of the electric contact part is provided with the guide protrusion having the oblique guide surface or bent guide surfaces. Alternatively, the tip of the body is formed with the square notched part. With this arrangement, the connector terminal is smoothly insertable into the terminal accommodating chamber of the housing. The workability is also improved. Besides, even when the terminal accommodating chamber is narrowed, the connector terminal can be inserted with no difficulty. The connector can be therefore made compact.

Although the illustrated embodiments of the present invention have been described with reference to the accompanying drawings, it is to be understood that the present invention is not limited to those embodiments. Various changes or modifications may be effected by one skilled in the art without departing from the scope or spirit of the invention.

What is claimed is:

1. A connector terminal comprising a wire connecting part; and an electric contact part integrally connected to said wire connecting part and comprising:

a hollow rectangular body having a first pair of opposing walls and a second pair of opposing walls, said first pair of walls terminating at a forward end of said rectangular body and only a single guide protrusion extending forwardly from said forward end of said rectangular body and being integrally found with at least one of said walls;

wherein said guide protrusion has a substantially forward-facing guide surface having outer side edges, said guide surface continually decreasing in width from said outer side edges to an intermediate point of said guide surface.

2. The connector terminal according to claim 1, wherein said guide surface is curved.

3. The connector terminal according to claim 1, wherein said guide protrusion has an arrowhead-like shape and said guide surface is linear.

4. The connector terminal according to claim 1, wherein said wire connecting part and said electric contact part are made of metal.

5. The connector terminal according to claim 1, wherein said electric contact part further includes a tongue-shaped spring member.

6. The connector terminal according to claim 5, wherein said tongue-shaped spring member comprises a separate member mounted to the rectangular body.

7. The connector terminal according to claim 1, wherein said guide protrusion extends continually from one of said walls and has substantially the same width as the wall from which it extends.

8. A connector terminal comprising a wire connecting part; and an electric contact part integrally connected to said wire connecting part, said electric contact part comprising:

a hollow rectangular body having a first pair of opposing walls and a second pair of opposing walls, said first and second pair of walls terminating at a forward end of said rectangular body, and guide means for guiding said electric contact into a terminal accommodating chamber of a connector housing, said guide means extending forwardly from said forward end of said rectangular body and being integrally formed with at least one of said walls, said guide means comprising a guide protrusion that has a substantially forward-facing guide surface with outer side edges, said guide surface continually decreasing in width from said outer side edges to an intermediate point of said guide surface.

9. The connector terminal according to claim 8, wherein said guide means comprises a guide protrusion that has a substantially forward-facing guide surface that is curved.

10. The connector terminal according to claim 8, wherein said guide means comprises a guide protrusion that has an arrowhead-like shape and has a substantially forward-facing guide surface that is linear.

11. The connector terminal according to claim 8, wherein said guide means comprises a guide protrusion that continually extends from one of said walls and has substantially the same width as the wall from which it extends.

* * * * *